US005872545A

United States Patent [19]

Rammos

[11] Patent Number: 5,872,545

[45] Date of Patent: Feb. 16, 1999

[54] PLANAR MICROWAVE RECEIVE AND/OR TRANSMIT ARRAY ANTENNA AND APPLICATION THEREOF TO RECEPTION FROM GEOSTATIONARY TELEVISION SATELLITES

[75] Inventor: Emmanuel Rammos, Oegstgeest, Netherlands

[73] Assignee: Agence Spatiale Europeene, Paris, France

[21] Appl. No.: 778,737

[22] Filed: Jan. 2, 1997

[30] Foreign Application Priority Data

Jan. 3, 1996 [FR] France ..... 96 00020

[51] Int. Cl.[6] ..... H01Q 13/10

[52] U.S. Cl. ..... 343/770; 343/700 MS; 343/829

[58] Field of Search ..... 343/778, 767, 343/776, 770, 789, 829, 826, 830; H01Q 1/38, 13/10

[56] References Cited

U.S. PATENT DOCUMENTS

| | | | |
|---|---|---|---|
| 5,400,042 | 3/1995 | Tulintseff | 343/727 |
| 5,453,751 | 9/1995 | Tsukamoto et al. | 343/700 MS |
| 5,499,033 | 3/1996 | Smith | 343/700 MS |

FOREIGN PATENT DOCUMENTS

| | | |
|---|---|---|
| 0123350 | 10/1984 | European Pat. Off. . |
| 0228742 | 7/1987 | European Pat. Off. . |
| 0252779 | 1/1988 | European Pat. Off. . |
| P 42 39 597.6 | 6/1993 | Germany . |
| 4313396 A1 | 10/1994 | Germany . |
| 2219143 | 11/1989 | United Kingdom . |
| PCT/GB95/ 00923 | 11/1995 | WIPO . |

*Primary Examiner*—Don Wong
*Assistant Examiner*—Tan Ho
*Attorney, Agent, or Firm*—Sughrue, Mion, Zinn, Macpeak & Seas, PLLC

[57] ABSTRACT

A receive and/or transmit microwave planar array antenna is of the multiplate stack type comprising a plurality of slot radiating elements disposed along the rows and the columns of a matrix. The basic stack comprises three ground plates incorporating openings and two independent excitation circuit planes, enabling transmission or reception of two inclined beams. At least two other excitation circuit planes are provided so that each beam can additionally have dual polarization. The excitation circuits are microstrips, coplanar waveguides, dipole lines, of the loop or slot type, or a combination of such lines. Two consecutive lines are oriented at 90° to each other. Applications include individual reception from two geostationary television satellites.

17 Claims, 5 Drawing Sheets

FIG_4
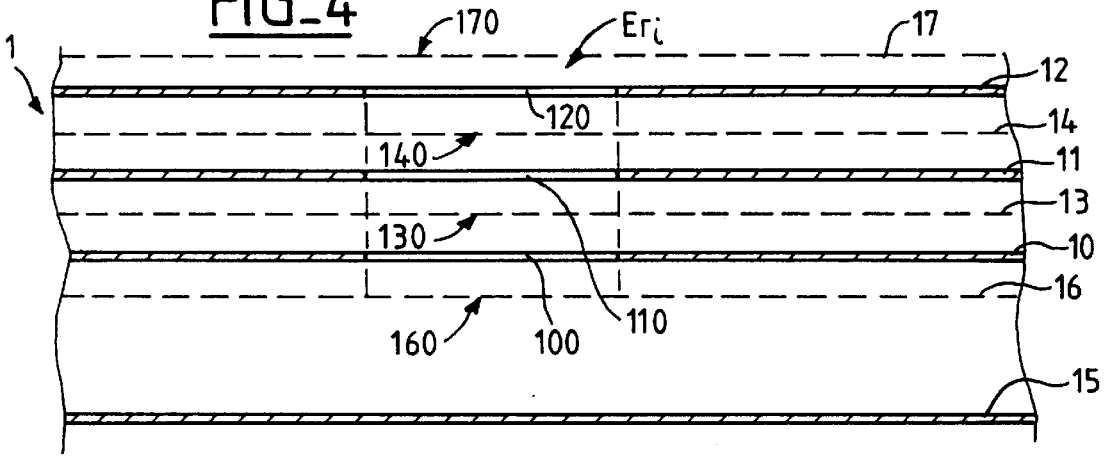
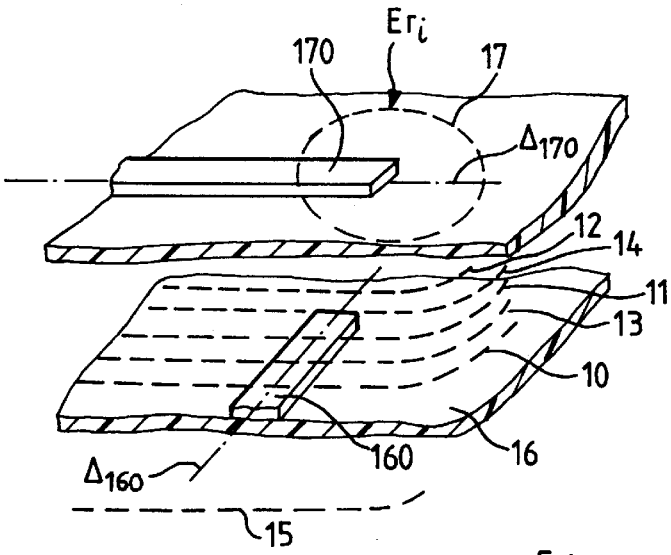
FIG_5
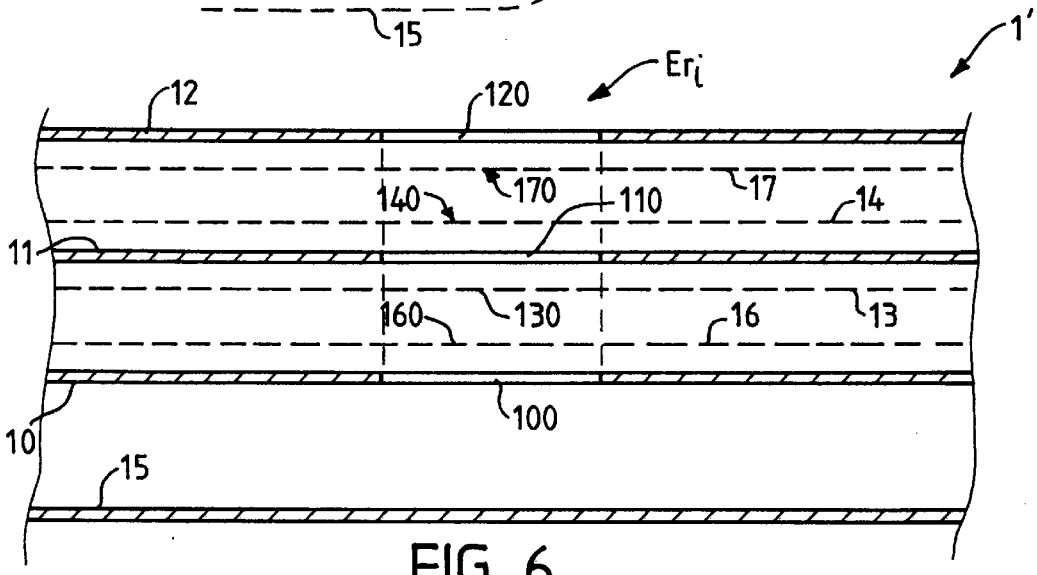
FIG_6

PLANAR MICROWAVE RECEIVE AND/OR TRANSMIT ARRAY ANTENNA AND APPLICATION THEREOF TO RECEPTION FROM GEOSTATIONARY TELEVISION SATELLITES

BACKGROUND OF THE INVENTION

1. Field of the invention

The invention concerns a planar microwave receive and/or transmit array antenna.

It is more particularly concerned with a dual polarization and dual beam antenna.

It also concerns the application of an antenna of this kind to individual reception from two geostationary television satellites, also known as DTH (Direct To Home) satellites, for example in the X band (12.1 GHz).

2. Description of the Prior art

It is clear that dual beam antennas are highly beneficial in many applications such as reception from two satellites in different orbital positions. This applies to pairs of satellites such as ASTRA and TELECOM, ASTRA and EUTELSAT, etc.

The standard technique uses parabolic antennas having two receive heads offset relative to the focusing point, each adapted to receive one of the beams. It is also possible to use motorized parabolic antennas enabling reception from two or more satellites, but these are of higher cost.

This type of antenna is naturally large, even if the high radiated power of recent satellites has made it possible to reduce the overall dimensions significantly. The esthetics of such antennas have also been criticized.

An interesting alternative to this type of antenna could be planar array antennas, essentially based on multilayer printed circuit boards, and more particularly antennas of the slot radiating element type.

However, despite considerable research and development effort, there are as yet no dual beam and dual polarization planar antennas for consumer applications of the above type that are both economical and suitable for mass production.

Furthermore, this type of antenna must have a high efficiency and a wide bandwidth to cover the bandwidth of the satellites to be received (typically 20% of the combined bandwidth).

Many planar antennas have been proposed. However, these are either projects that did not get beyond the laboratory stage (experimental antennas) or antennas for professional use, for example for radar applications.

There follows a non-exhaustive list of such antennas:

An experimental radial line dual beam type planar antenna is proposed in the article by Jun-Ichi Takada et al: "A Dual Beam-Polarized Radial Line Slot Antenna" published in "IEE Antennas and Propagation Society International Symposium", 1993, pages 1624–1627. However, this antenna provides only one polarization per beam. It should also be noted that a radial line antenna provides only a narrow bandwidth (less than 5% of the combined bandwidth). Furthermore, the structure adopted has inherent tight manufacturing constraints, even in a single beam version. The problems are naturally more severe in a dual beam version.

Inclined beams for array type antennas can be generated by feeding the radiating elements of such antennas with signals having a progressive phase-shift to match the phase differences of the inclined wave received by each radiating element.

This phase-shift can be obtained in the circuit feeding the array by many methods, for example using phase-shifters, delay lines, etc. These methods are well known in the context of radar or space transmission applications.

In the case of fixed beam passive arrays, the phase-shift can be obtained by appropriate modification of the length of the feed lines, as described, for example, in "Handbook of Microstrip Antennas", R. P. OWENS, J. R. James Hall, P. S. Hall, IEE, Vol. II, 1989, Peter Peregrinus, London, pages 825–843 and 856–866 (see more particularly (figure 14.9).

For multiple beams, a plurality of radiating element phase excitations are required, using beam forming networks. Blass or Butler matrices may be used for this, for example.

These methods are relatively simple to implement in the case of linear arrays, but not in the case of planar two-dimensional arrays. It becomes very difficult to lay out the required circuits, feed lines, power dividers, hybrid circuits, etc, especially when there are hundreds of radiating elements, as in large size array antennas suitable for receiving from direct broadcast television satellites. These components have to be inserted between the radiating elements.

Moreover, in this type of application the series feeds described in the aforementioned book (figure 14.33) are not suitable anyway since the bandwidth is limited for large size arrays.

Other types of feed have been proposed, for example in European patent application EP-A-0 252 779 (Emmanuel RAMMOS), more particularly with reference to figure 16. The structure described (length of the excitation line and the output connectors) provides a large bandwidth. However, the antenna described provides dual polarization or a dual beam but not both at once.

Finally, the combination of series feeds and matrices or hybrid circuits is also possible. One such combination is disclosed in the aforementioned book, more particularly with reference to figure 14.35, but it does not provide sufficient bandwidth for the preferred application of the invention. What is more, it is in practise restricted to relatively small arrays.

One possible solution, meeting all the requirements of the preferred application of the invention and solving all the problems that have been raised, would be to implement transitions between the radiating elements and multilayer feed arrays. This technique has been used in the case of generation of dual polarization for vertical transition arrays. It is described in the aforementioned book, with reference to figure 14.32.

However, it should be noted that transition radiating elements are in practise ruled out for antennas for receiving from direct broadcast television satellites. They have a narrow bandwidth, require the use of high-performance dielectric materials and imply very tight manufacturing tolerances. Even in the case of dual polarization at only two levels, feed transition arrays are not suitable for an antenna for receiving from satellites. Arrays of this kind have not been marketed. A fortiori, at the manufacturing stage, this type of transition array is not compatible with multilayer feeds, without having recourse to vertical transitions, soldering, etc, which are highly complex and costly.

The teachings that can be drawn from prior art antennas and studies we have carried out show that, realistically, an antenna for "consumer" requirements must be derived in a simple manner from an existing planar antenna design. It must additionally offer a dual beam and dual polarization reception facility for it to be applied to receiving from direct broadcast television satellites. More generally, it must offer a transmit and/or receive capability having this two-fold property for less specific applications.

An object of the invention is therefore to provide an antenna of the aforementioned type, compatible with all the stated requirements, in particular low manufacturing cost, easy manufacture with no need to comply with tight tolerances, high efficiency and large bandwidth. It additionally offers the two-fold property just referred to.

To this end, the antenna of the invention retains most of the features of the structure adopted for prior art planar antennas, advantageously those of the antenna described in the previously mentioned European patent application EP-A-0 252 779.

This latter antenna, in an embodiment with provision for dual polarization, comprises slot radiating elements. To this end, a stack of three metal ground plates is provided, having openings and a pair of suspended printed circuit technology microstrips. The microstrips are disposed between the ground plates, one for the vertical polarization and the other for the horizontal polarization.

As described in detail hereinafter, to achieve the object of the invention it is sufficient to add to this basic structure a pair of feed circuits, one on top of the sandwich formed by the aforementioned three plates and the other under it.

In a preferred embodiment of the invention each pair of microstrips (or more generally transmission lines) has the dual polarization facility.

By virtue of these arrangements, the antenna of the invention has a dual beam and dual polarization receive and/or transmit capability enabling it to receive from and/or transmit to two different directions an electromagnetic signal having two different polarizations.

SUMMARY OF THE INVENTION

Accordingly, the invention consists in a microwave planar array antenna comprising a plurality of slot radiating elements in a particular configuration, the antenna being made up of a multiplate stack comprising first, second and third ground plates substantially parallel to each other, each provided with openings of particular shape and aligned in pairs along an axis orthogonal to the planes formed by said three plates, and independent first and second excitation circuits disposed in first and second planes, said first plane being between said first and second ground plates and said second plane being between said second and third ground plates, said excitation circuits comprising suspended signal transmission lines cooperating with said openings by electromagnetic coupling to form said radiating elements, said excitation circuits being such that the antenna transmits and/or receives first and second electromagnetic wave beams in and/or from two directions inclined to each other, wherein said stack comprises at least third and fourth independent excitation circuits disposed in said third and fourth planes and said excitation circuits comprise suspended signal transmission lines and cooperate with said openings and with said first and second excitation circuits by electromagnetic coupling to obtain dual polarization for each of said first and second electromagnetic wave beams.

Another object of the invention is to apply an antenna of the above kind to direct reception from geostationary television satellites in different orbital positions.

The invention will be better understood and other features and advantages will emerge from a reading of the following description given with reference to the accompanying drawings.

BRIEF DESCRIPTION OF THE DRAWINGS

FIG. 4 is a diagrammatic sectional view of a first embodiment of an antenna of the invention.

FIG. 5 is a partly cut away detail view of one embodiment of microstrip line that can be used in the FIG. 4 antenna.

FIG. 6 is a diagrammatic sectional view of a second embodiment of antenna of the invention.

DETAILED DESCRIPTION OF THE PREFERRED EMBODIMENTS

As already mentioned, many planar antenna structures have been proposed, in particular that described in the previously mentioned European patent application EP-A-0 252 779. To provide a clear idea of the invention, although the latter structure is subject to variants, one example of an antenna of the invention will now be described with reference to it. It must nevertheless be understood that this example is not in any way limiting on the scope of the invention.

Likewise, the example relates to the preferred application of the invention, i.e. reception from two direct broadcast television satellites in different orbital positions. It follows that the antenna receives the two beams transmitted at different reception angles.

Figure 1:
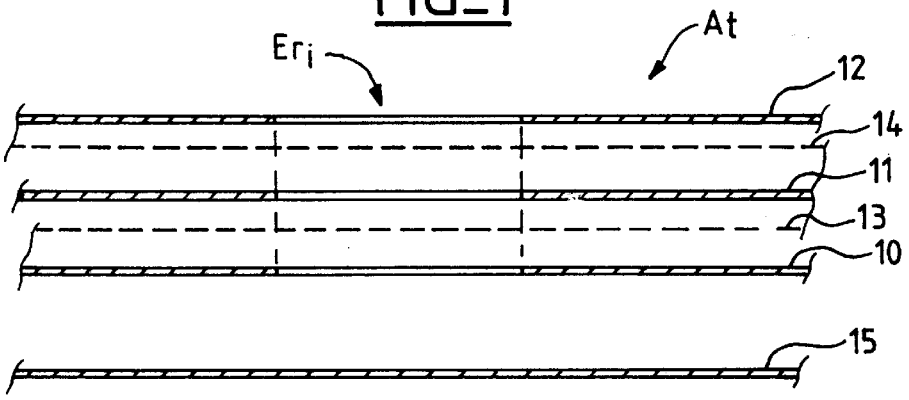
PRIOR ART FIG 1
FIG. 1 is a diagrammatic sectional view of a prior art antenna like that described with reference to figure 6 of European patent application EP-A-0 252 779.
Figure 2:
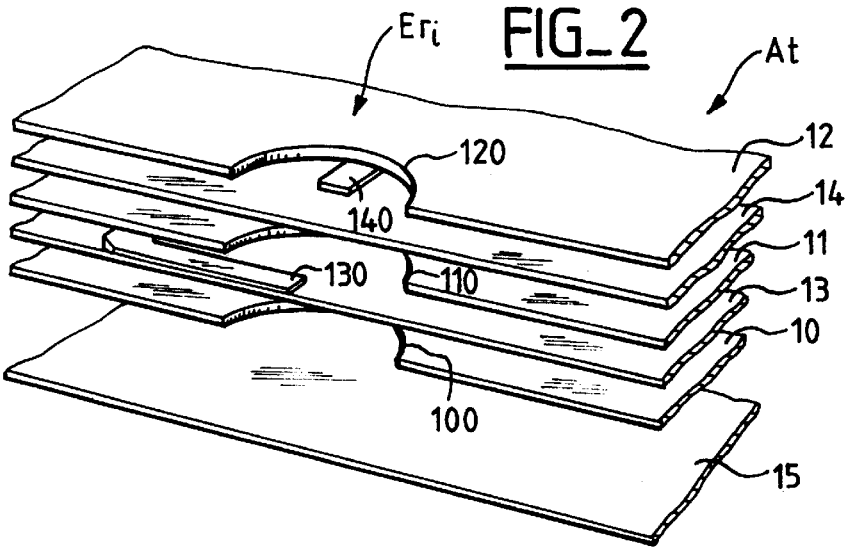
FIG. 2 is an exploded sectional view of one of the radiating elements of an antenna of this kind.

The principal features of the basic structure of an antenna of this kind are first briefly summarized with reference to FIGS. 1 and 2. FIG. 1 is a schematic representation of the planar antenna At in section. FIG. 2 is a cut away detail view of the antenna showing one of the radiating elements Eri where i takes all values between 1 and the total number of radiating elements. It must be clearly understood that this type of antenna includes many radiating elements Eri arranged along the rows and the columns of a matrix configuration, for example, to form an array.

Basically, the antenna shown in FIGS. 1 and 2 is of the suspended microstrip line type, comprising central conductors 140 carried by a dielectric support film 14. The latter is suspended between top and bottom metal plates 12 and 11, respectively. The plates incorporate respective openings 120 and 110 (circular openings in the example described) aligned in pairs with the projecting terminations of the central conductors 140 forming the microstrips.

In reality the planar array antenna variant At shown in FIGS. 1 and 2 is more complex, since it makes provision for dual polarization or dual beam operation.

For this, two additional plates 10 and 13 are provided.

The plate 13 is a film of dielectric material and supports elongate conductors 130 forming microstrips and similar to the conductors 140. They are disposed in two mutually orthogonal directions, however.

The plate 10 is a metal plate and incorporates openings 100 aligned with the openings 110 and 120.

To be more precise, for each radiating element Eri of the array of the antenna At there are two independent power feed lines (not shown) in two separate planes, for example the planes of the dielectric films 13 and 14. The microstrips 130 and 140 constitute the active terminations of these feed lines.

The basic multiplate structure of the planar array antenna At is therefore made up of five plates or films. This basic multiplate structure is completed by a reflective metal back plate 15.

The "vertical" polarization excitation is provided by the microstrip circuit 140, for example and in this case the "horizontal" polarization is provided by the microstrip circuit 130. These functions can of course be interchanged.

Note that in the example described the middle is ground plate 11 is used by both the microstrip circuits 130 and 140.

The relative positions of the planes 10, 13, 11, 14 and 12 and 15, the dimensions of the openings 120 and 110 and the length of the projecting terminations of the central conductors 130 and 140 are determined so that the openings 120 and 110 act as radiating slots coupled electromagnetically to the feed line for a relatively wide band of operating frequencies.

The openings 120 and 110 of the same pair have their centers aligned on a vertical axis (i.e. an axis orthogonal to the plates of the structure) and can have the same diameter. However, the diameters of the openings of the same pair may be slightly different, the effect of which is to increase the bandwidth.

The operating frequency of each opening depends essentially on its dimensions and if two openings of the same pair have slightly different central operating frequencies the total bandwidth is increased. The diameter of the openings 120 and 110 is in the order of 0.3 to 0.7 wavelength.

The spacing between two consecutive elements along a row or a column of the previously mentioned matrix configuration is advantageously in the range of 0.7 to 0.9 wavelength.

The reflective backplate 15 imparts a specific direction to the radiated energy. It is at a distance from the multiplate structure of the antenna At in the order of one quarter of the wavelength. This distance is very important since it yields the possibility of optimizing operation conjointly to the dimensions of the power feed line 130 and 140 and of the various microstrip printed arrays.

Each excitation line can be matched by adjusting the length of the terminations projecting in line with the aforementioned openings 100, 110 and 120 and the distance between the multiplate structure and the reflective back plate 15. By imparting phase-shifts of +90° and −90° to the signals carried by the excitation lines it is possible to obtain circular, right or left polarization, respectively. If a −3 dB hybrid circuit is used to combine the signals from two linear polarization outputs, it is possible to obtain a dual circular polarization.

To obtain two inclined beams with an array antenna of this kind it is sufficient to excite the radiating elements $Er_i$ by signals with an appropriate phase-shift. This can be achieved simply by modifying the printed circuit feedlines shown in FIG. 3, which conform to those shown in figure 16 of the previously mentioned European patent application.

Figure 3:
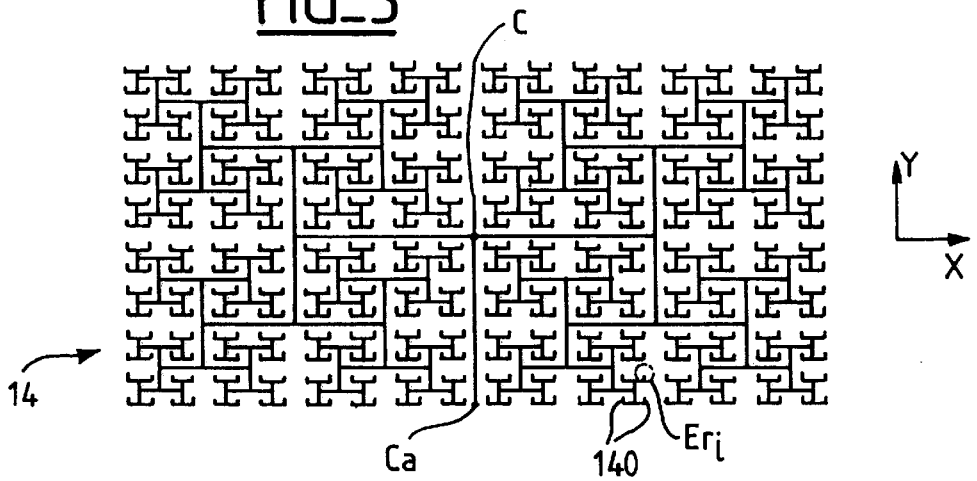
FIG. 3 shows one example of printed circuit feedlines for an antenna of this kind.

FIG. 3 shows the configuration of the excitation circuits carried by the dielectric support 14, referenced to two orthonormic axes YX. The primary feed circuit Ca starts from a single line entering the plate 14 parallel to the Y axis (in this example) and which is split regularly in a tree structure comprising a series of lines parallel to the Y and X axes. The ultimate terminations of this tree structure feed the microstrips 140. FIG. 3 shows that the circuit topology is highly symmetrical about the center C of the plate 14 (first subdivision). Moreover, all the lines constituting the feed circuits pass between the slots of the radiating elements $Er_i$ and define interlinked and interleaved "HE" shapes oriented alternately along the two X and Y axes, with regularly decreasing dimensions.

Thus, to convert a dual polarization antenna to a dual beam antenna for receiving or transmitting two beams inclined to each other it is sufficient to determine the configuration of the feed lines to transmit signals with is appropriate phase-shifts to the radiating elements $Er_i$. This can be achieved by adjusting the length of the lines to the radiating elements $Er_i$ or by shifting the thresholds of the power dividers feeding these lines, or a combination of the two as described in the aforementioned book, more particularly with reference to figure 14.9.

The global structure of the antenna At remains unchanged, since the modifications are exclusively to the printed circuit feed array and do not affect the remainder of the components.

However, as already mentioned, this type of antenna provides only dual polarization or a dual beam. It does not cater for the two-fold property, i.e. dual polarization and dual beam (two separate transmit and/or receive directions).

To the contrary, one important feature of the antenna of the invention is that it has a combined dual beam and dual polarization capability.

To achieve this, in a first embodiment shown diagrammatically in FIG. 4, it is sufficient to add to the basic multiplate structure just described with reference to FIGS. 1 and 2 two additional circuits 160 and 170. Each of these circuits comprises suspended printed circuit microstrips for the dual polarization of one of the two beams (the beam arbitrarily labeled No. 1). The first circuit 170 is placed on a dielectric film 17 "on top" of the sandwich (in this instance on top of the top plate 12); the second circuit 160 is on a dielectric film 16 under the bottom plate 10.

The functions of the circuits of the various layers of the sandwich forming the basic structure of the antenna 1 are as follows, for example:

microstrips 170: horizontal polarization of beam No. 1;

microstrips 140: horizontal polarization of beam No. 2;

microstrips 130: vertical polarization of beam No. 2;

microstrips 160: vertical polarization of beam No. 1.

Other combinations are naturally possible.

The above microstrips naturally cooperate with the openings 100, 110 and 120 in the metal plates 10, 11 and 12 to form the slot radiating elements $Er_i$ .

As shown in more detail in FIG. 5, in this example, for each radiating element $Er_i$ , the microstrips 160 and 170 are disposed on their respective supports 16 and 17 in two mutually orthogonal directions $D_{160}$ and $D_{170}$ to obtain crossed polarization, i.e. horizontal and vertical polarization.

It is readily apparent that most of the structure of the prior art antenna is retained. It is only necessary to add two circuits, the top circuit 160 and the bottom circuit 170. The additional cost of this, whether in terms of materials or additional manufacturing operations, is very small (a few percent).

The middle metal plate can be omitted if the circuits on either side of it are spaced in some appropriate manner.

Figure 7:
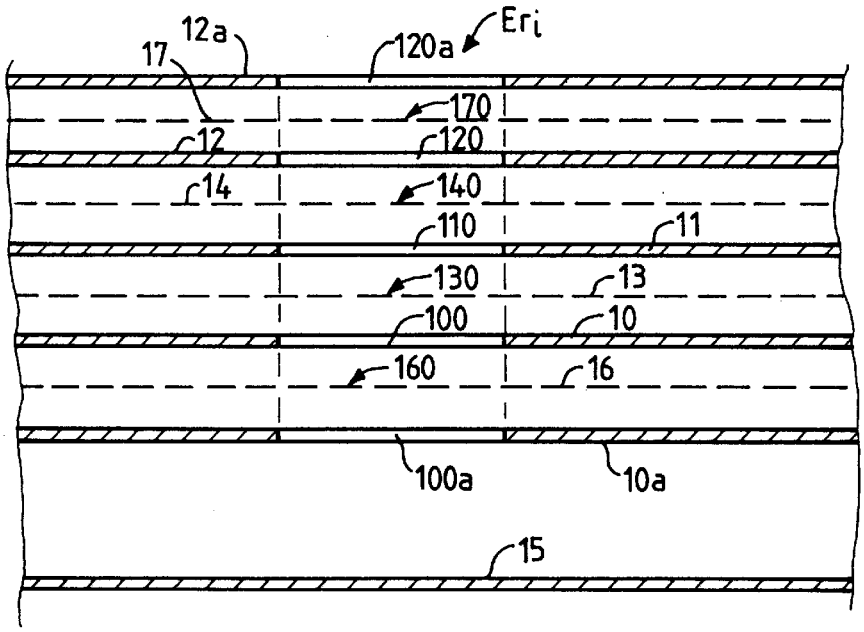
FIG. 7 is a diagrammatic sectional view of a third embodiment of antenna of the invention.

Other variants of the sandwich structure may be used, as shown in FIGS. 6 and 7.

FIG. 6 is a diagrammatic sectional view of a first variant. The planar antenna 1' is made up, as previously, of three metal plates 10, 11 and 12 incorporating respective openings 100, 110 and 120 to form the slot radiating elements $Er_i$. The arrangement within the layers of the sandwich is different. The circuits 160 are on top of the plate 10 (the bottom plate of the sandwich). The circuits 130 and 140 are on opposite sides of the intermediate plate 11 (below and above it, respectively). The circuits 170 are under the plate 12.

In this embodiment the microstrips can be replaced by coplanar waveguides.

The functions of the various layers of the sandwich 1' are as follows:

microstrips or coplanar waveguides 170: polarization No. 1, beam No. 1;

microstrips or coplanar waveguides 140: polarization No. 2, beam No. 1;

microstrips or coplanar waveguides 130: polarization No. 1, beam No. 2;

microstrips or coplanar waveguides 160: polarization No. 1, beam No. 1.

In this embodiment the expression "polarization No. 1" means either the horizontal polarization or the vertical polarization, the expression "polarization No. 2" referring to the other of these two polarizations. Which is which depends on the relative direction of the microstrips 160, 130, 140 and 170.

As previously, other combinations are naturally possible.

FIG. 7 shows another example of a multiplate structure of a planar array antenna 1".

The sandwich forming the antenna 1" is made up of five metal plates 10*a*, 10, 11, 12 and 12*a* (plate 10*a* being the bottom plate of the sandwich 1" in FIG. 7), incorporating respective openings 100*a*, 100, 110, 120 and 120*a*, and four dielectric material films 16, 13, 14 and 17 supporting respective microstrips or coplanar waveguides 160, 130, 140 and 170.

The functions of the various layers of the multiplex structure 1" are as follows:

microstrips or coplanar waveguides 170: polarization No. 1, beam No. 1;

microstrips or coplanar waveguides 140: polarization No. 2, beam No. 1;

microstrips or coplanar waveguides 130: polarization No. 1, beam No. 2;

microstrips or coplanar waveguides 160: polarization No. 1, beam No. 1.

The meanings of the expressions "polarization No. 1" and "polarization No. 2" are the same as for the variant shown in FIG. 6.

Practical methods of fabricating the various planar antennas of the invention just described will now be explained. To make the following example more concrete, it considers the embodiment of FIGS. 4 and 5 (microstrips), on the understanding that the arrangements described hereinafter apply also to the other embodiments. Likewise, to avoid overcomplicating the drawings, only the plane 16 carrying the microstrips 160, the ground plane 10 including the openings 100 and the plane 13 supporting the microstrips 130 are shown. The same arrangements are repeated between each support plane-ground plane combination.

Figure 8:
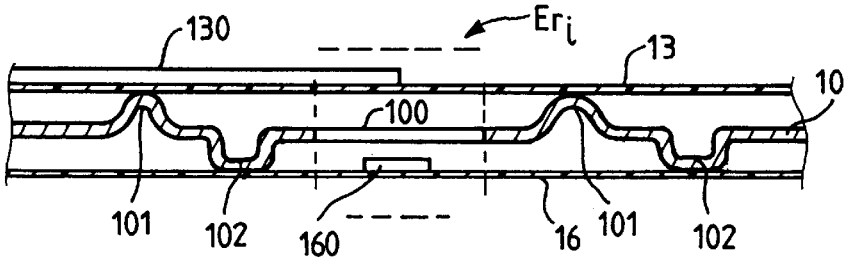
FIGS. 8 through 10 show in section three embodiments of spacer members between plates.
Figure 9:
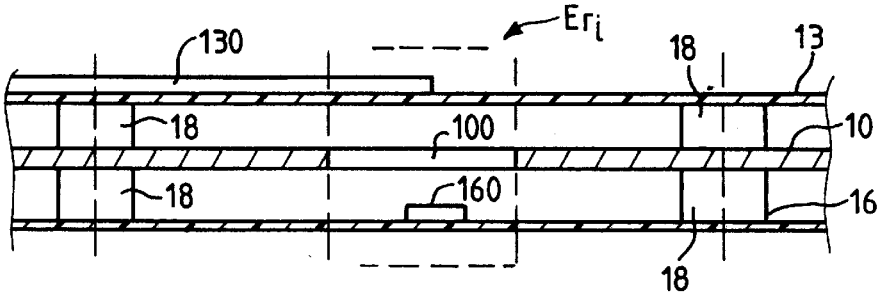
Figure 10:
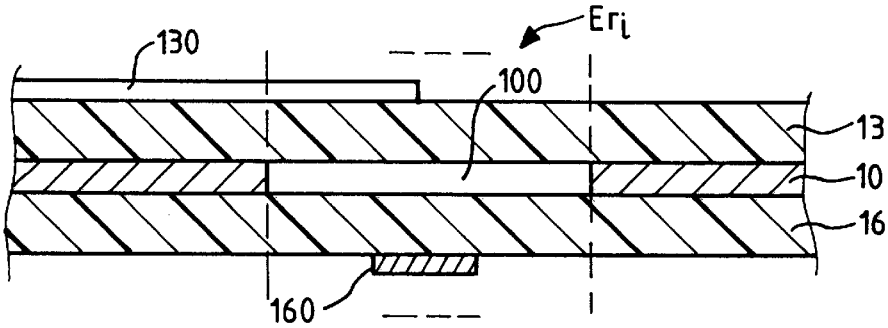

FIGS. 8 through 10 are detail sectional views showing three embodiments of means for spacing the plates 16 or 13 carrying the microstrips 130 and 160 relative to the ground plane 10.

In a first variant, shown in FIG. 8, the spacing between two circuit support planes, for example the planes 160 and 130, is obtained by bosses 101 and 102 in the intermediate metal ground plane 10. To be more precise, these bosses are alternately "positive" (upwards in the figure) half-waves 101 in contact with the support 13 and "negative" (downwards in the figure) half-waves in contact with the support 16. These supports 16 and 13 are advantageously made from dielectric films (for example of Mylar® or Kapton®) on which the printed circuits of the printed microstrips 160 and 130, respectively, are etched. The thickness of these films is typically in the order of 25 gm to 75 gm.

For the preferred application of the invention, i.e. reception from two geostationary television satellites, the wavelength being in the X band (12.1 GHz), the spacing between two support planes is typically in the range 0.5 mm to 2 mm. In the variant described with reference to FIG. 8 the bosses therefore have an "amplitude" of approximately 0.25 mm to 1 mm.

The spacing may equally well be provided by layers of expanded dielectric foam of the appropriate thickness.

In the second variant, shown in FIG. 9, the spacing is provided by spacers 18 disposed between the planes 16 and 10 and between the planes 10 and 13. Various materials may be used: plastics materials, foam, metal, etc. Similarly, fixing may be by conventional means: screws, glue, etc.

The spacers 18 may also be used as mode suppressors.

In a third variant, shown in FIG. 10, the supports 16 and 13 are dielectric material plates of greater thickness and are used both as supports and as spacer members. In this variant the metal grounding circuit 10 including the openings 100 is etched on either or both of the two plates 16 and 13. In other words, at least one of the plates 16 and 13 is a double-sided printed circuit.

Similarly, the type of transmission line used may be a microstrip, as already mentioned. It may nevertheless be of other conventional types: slot, coplanar, two-wire line, loop, dipole, slot radiating elements, or any combination of these types of line.

FIGS. 11 through 15 show a few of these various types of line.

Figure 11:
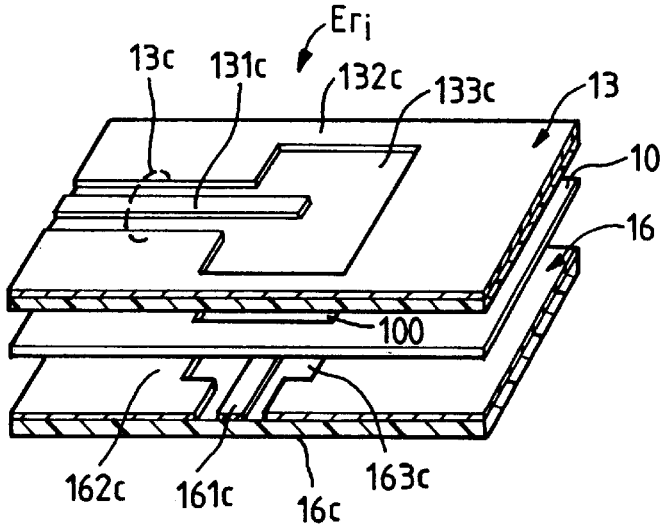
FIGS. 11 through 15 show, partly cut away, five embodiments of transmission lines and radiating elements that can be used in an antenna of the invention.

FIG. 11 shows one example of coplanar waveguides 16*c* and 13*c* formed on the supports 160 and 130, respectively and separated by the ground plane 10 incorporating the openings 100.

In this example, each line comprises an elongate central conductor 131*c* or 161*c* leading into an open area 163*c* or 133*c* of a metal patch 162*c* or 132*c* that is square or circular in shape, for example. The central conductor 161*c* or 131*c* is surrounded by a solid metal area: the external conductors 162*c* or 132*c*, also surrounding the open area 163*c* or 133*c*.

The ground plane 10 is made up of a metal plate comprising openings 100 aligned with the openings 163*c* and 133*c*.

The printed circuit supports 16 and 13 may be dielectric films, as previously, if spacers or other spacing members are used (FIGS. 8 and 9), or thicker dielectric plates (FIG. 10).

Figure 12:
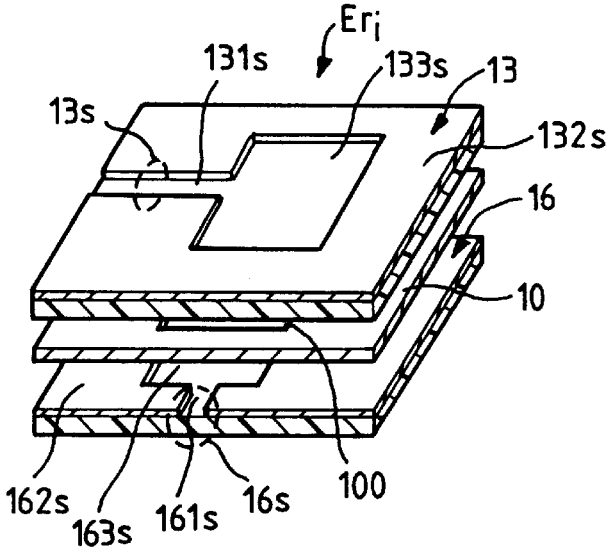

FIG. 12 shows one example of slot lines 16*s* and 13*s* formed on the supports 16 and 13, respectively, and separated by the ground plane 10 incorporating the openings 100.

In this example, each slot line comprises a central slot 131*s* or 161*s* leading into an open area 162*s* or 132*s* of a metal patch 163*s* or 133*s* that is square in shape, for example. This central slot 161*s* or 131*s* is surrounded by a solid metal area 162*s* or 132*s* also surrounding the opening 163*s* or 133*s*.

The ground plane 10 and the supports 16 and 13 have the same structure as previously.

Figure 13:
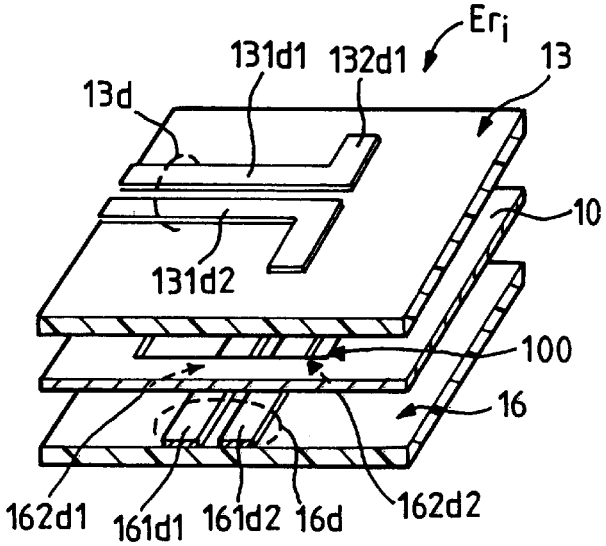

FIG. 13 shows one example of two-wire lines with dipole members 16*d* and 13*d* formed on the supports 16 and 13, respectively, and separated by the ground plane 10 incorporating the openings 100.

In this example each line comprises two parallel strips 161*d*1–161*d*2 and 131*d*1–131*d*2, respectively. These two parallel strips are extended, in an area below (for the line 16*d*) or above (for the line 13*d*) the opening 100, by two branches 162*d*1–162*d*2 and 132*d*1–132*d*2, respectively, at an angle of 90° to the aforementioned microstrips.

The ground plane 10 and the supports 16 and 13 have the same structure as previously.

Figure 14:
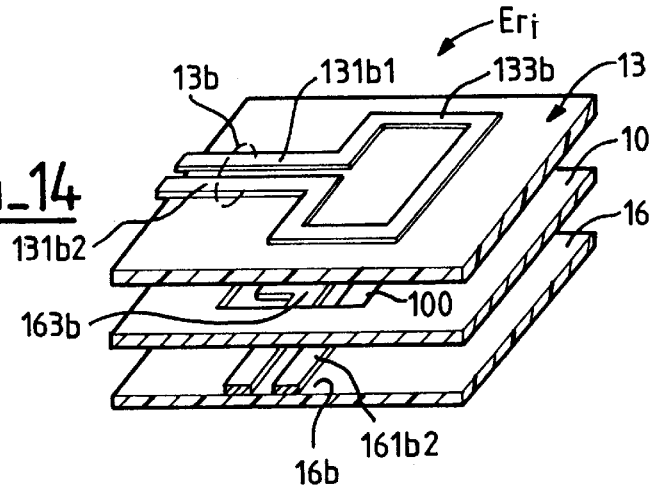

FIG. 14 shows one example of two-wire lines with looped members 16*b* and 13*b* formed on the supports 16 and 13, respectively and separated by the ground plane 10 incorporating the openings 100.

In this example, each line comprises two parallel strips 161*b*1–161*b*2 and 131*b*1–131*b*2, respectively. These two parallel strips are extended, in an area below (for the line 16*d*) or above (for the line 13*d*) the opening 100 by a respective loop 163*b* and 133*b*. To be more precise, the loop 163*b* or 133*b* has the same shape as the opening 100 so that it is aligned with the latter.

Figure 15:
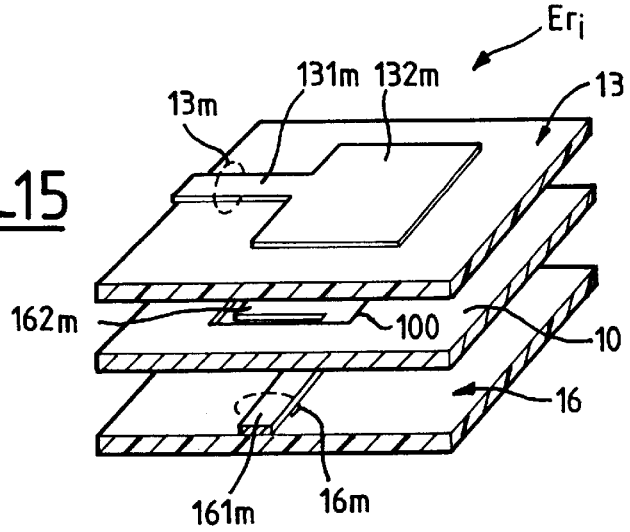

FIG. 15 shows another example of a suspended microstrip line configuration. The genera) structure is similar to that shown in FIG. 5.

The only noteworthy exception to this is that the microstrips 16*m* and 13*m* each comprises two parts: a microstrip part proper 163*m* and 131*m*,respectively, ending in a solid central metal patch 162*m* and 132*m*, respectively. To be more precise, the solid central metal patch 162*m* or 132*m* has substantially the same shape as the opening 100 so that it is aligned with the latter.

The solid central metal patch (for example the patch 162*m* or 132*m* in FIG. 15) and the openings 100 may be of various shapes: square, circular, elliptical, cruciform, annular, etc.

Furthermore, as already mentioned, in more complex embodiments, not shown, these various line structures may be combined.

Various features known in themselves in the field of reception and/or transmission in the aforementioned frequency band may be employed in the context of the invention: "baluns", elimination of spurious modes by ground continuity pins between ground planes, etc.

In practise, the structure of the complete antenna may conform to that disclosed by the previously mentioned European patent application EP-A-0 252 779. The complete antenna comprises two main parts: a multiplate stack and an external ground plane 15 forming a reflector.

Figure 16:
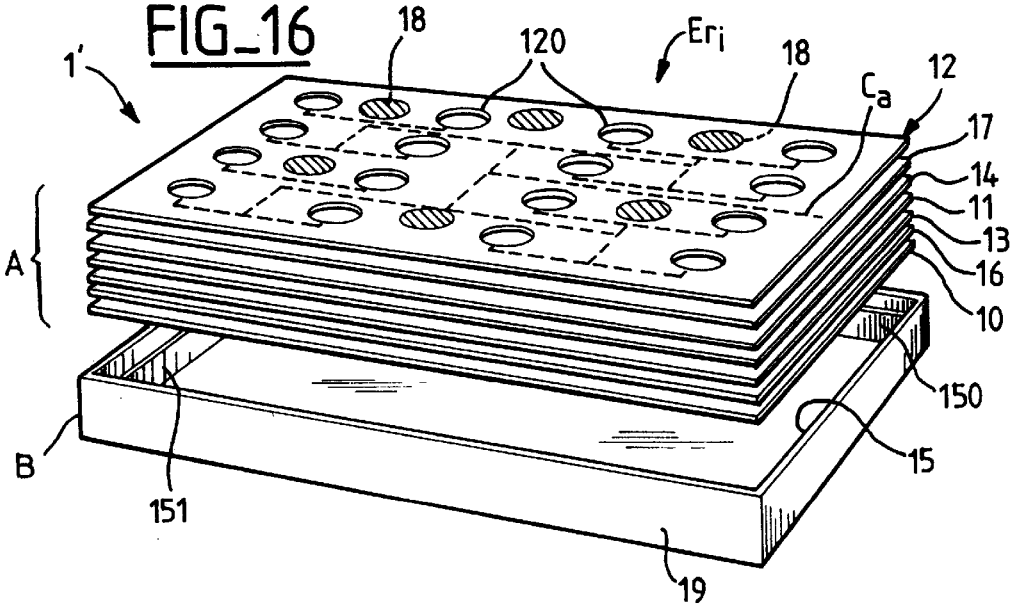
FIG. 16 is a diagrammatic exploded view of one complete embodiment of antenna of the invention.

FIG. 16 is a diagram showing one embodiment of a complete planar array antenna. To make the example more concrete, the antenna structure 1' from the FIG. 6 variant is used here.

The multiplate stack constitutes a first part A of the antenna shown in FIG. 16.

In this embodiment, the top plate of the stack is a ground plane 12 incorporating openings 120. The lower planes comprise, in succession, from the top downwards: two excitation circuit planes 17 and 14 (FIG. 6: 170 and 140), an apertured middle ground plane 11 (FIG. 6: 110), two further excitation circuit planes 13 and 16 (FIG. 6: 130 and 160), and an apertured bottom ground plane 10 (FIG. 6: 100).

The excitation circuits constitute the active terminations of the power feed circuits Ca (for a transmit antenna) or signal transmission circuits (for a receive antenna), shown in dashed line in FIG. 16.

The openings (for example the openings 120 in the plate 12) are regularly disposed at the intersections of the rows and the columns of a rectangular matrix.

It is assumed in this example that the various plates are spaced by means of spacers 18.

The second part B of the antenna 1' shown in FIG. 16 is a metal box 19 the bottom of which provides an external ground and acts as the reflective plate 15. The space between the first circuit support or the first apertured ground plane, depending the embodiment (for example, the ground plane 10 in this example) can advantageously be filled with foam. Similarly, the plates can be spaced by layers of foam.

The assembly can of course be completed by a protective envelope (not shown) of plastics material, for example, that is permeable to electromagnetic waves. This is known in itself.

The structure 19 forms a box with a bottom and upstanding lateral edges 150 and 151. In a variant that is not shown it is possible to use cavities behind each radiating element or group of radiating elements (for example those of the columns). This embodiment is described in the previously mentioned European patent application. This cavity structure generally allows greater inclination of the two waves transmitted or received relative to each other.

Finally, the invention caters for multiple combinations of beam polarizations: for example, a dual linear polarization plus two crossed polarizations.

A reading of the above description makes it readily apparent that the invention achieves the stated objectives. In particular, with no significant increase in the complexity of the circuit, there is obtained an antenna able to transmit and/or to receive in two directions and with two polarizations, with good efficiency and sufficient combined bandwidth. The additional cost is also very small. It follows that the antenna of the invention is perfectly suitable for consumer applications, especially in the preferred application, i.e. reception of television programs from two geostationary broadcast satellites.

Note in particular that the ground plane and the box may be of pressed sheet metal, a manufacturing operation which is both simple and low in cost.

It must nevertheless be clear that the invention is not limited to the embodiments specifically described, in particular with reference to FIGS. 4 through 16.

Among other things, the various materials and dimensions are given by way of example only. The antenna essentially uses only technologies that are known in themselves and that are routinely used in the field of transmission and/or reception, in particular in the range of frequencies around 12 GHz in the preferred application of receiving from geostationary satellites. It follows that the above parameters (dimensions, choice of materials) merely constitute a basic technological choice that will be evident to the person skilled in the art and that depend essentially on the precise intended application.

It must also be clear that, although particularly suited to the aforementioned application, the invention is not restricted to this type of application alone. It applies equally to the transmission and/or the reception of electromagnetic waves in and/or from two different directions with the simultaneous facility for dual polarization.

There is claimed:

1. A microwave planar array antenna comprising a plurality of slot radiating elements, the antenna being made up of a multiplate stack comprising first, second and third ground plates substantially parallel to each other, each provided with openings and aligned in pairs along an axis orthogonal to the planes formed by said three plates, and independent first and second excitation circuits disposed in first and second planes, said first plane being between said first and second ground plates and said second plane being between said second and third ground plates, said excitation circuits comprising suspended signal transmission lines cooperating with said openings by electromagnetic coupling to form said radiating elements, said excitation circuits being such that the antenna transmits and/or receives first and second electromagnetic wave beams in and/or from two directions inclined to each other, wherein said stack comprises at least third and fourth independent excitation circuits disposed in third and fourth planes and said third and fourth excitation circuits comprise suspended signal transmission lines and cooperate with said openings and with said first and second excitation circuits by electromagnetic coupling to obtain dual polarization for each of said first and second electromagnetic wave beams.

2. The antenna claimed in claim 1 wherein said third and fourth planes containing said third and fourth excitation circuits are respectively on top of and underneath said first and third ground plates of said multiplate stack.

3. An antenna as claimed in claim 2 further comprising fourth and fifth ground plates, substantially parallel to each other and parallel to said first, second and third ground plates, each incorporating openings, wherein said openings of all said ground plates are aligned in pairs along an axis orthogonal to the planes formed by said plates and said fourth and fifth ground plates are respectively disposed on top of said third excitation circuit and underneath said fourth excitation circuit.

4. The antenna claimed in claim 1 wherein said third plane containing said third excitation circuit is between said first ground plate and said first excitation circuit and said fourth plane containing said fourth excitation circuits is between said third ground plate and said second excitation circuit.

5. The antenna claimed in claim 1 wherein said excitation circuits are supported by dielectric material films and spacing means are provided between two successive support films or between a support film and a ground plate.

6. The antenna claimed in claim 5 wherein said spacing means comprise bosses pressed into said ground plates.

7. The antenna claimed in claim 5 wherein said spacing means comprise a layer of dielectric foam.

8. The antenna claimed in claim 5 wherein said spacing means comprise spacers.

9. The antenna claimed in claim 5 wherein said spacing means comprise the dielectric material of said film supporting said excitation circuits, at least one part of said film constitutes a double-sided printed circuit and at least part of said ground plates is formed by a metal film incorporating openings supported by at least one of the faces.

10. The antenna claimed in claim 1 wherein said suspended signal transmission lines are strips extended by a solid metal patch aligned with said openings and two successive strips are disposed in mutually orthogonal directions.

11. The antenna claimed in claim 1 wherein said suspended signal transmission lines are coplanar waveguides, each coplanar waveguide comprises an elongate central conductor leading into an open area of a metal patch and said elongate central conductors of two successive coplanar waveguides are disposed in mutually orthogonal directions.

12. The antenna claimed in claim 1 wherein said suspended signal transmission lines are slot lines, each slot line comprises a central slot leading into an open area of a metal patch and said central slots of said slot lines of two successive coplanar waveguides are disposed in mutually orthogonal directions.

13. The antenna claimed in claim 1 wherein said suspended signal transmission lines are two-wire lines with a dipole member, each two-wire line with a dipole member comprises two parallel strips extended by two branches at an angle of 90° to said strips and said parallel strips of two successive dipole members are disposed in mutually orthogonal directions.

14. The antenna claimed in claim 1 wherein said suspended signal transmission lines are two-wire lines with a looped member, each two-wire line with a looped member comprises two parallel strips extended by a loop of particular shape and said parallel strips of two successive two-wire lines with a looped member are disposed in mutually orthogonal directions.

15. An antenna as claimed in claim 1 further comprising an additional external ground plate forming a reflector and wherein said external ground plate is at a distance from said stack substantially equal to one quarter of the wavelength of the beams transmitted and/or received by the antenna.

16. The antenna claimed in claim 15 wherein said stack is disposed in a metal box the bottom of which constitutes said reflector.

17. The application of an antenna as claimed in claim 1 to individual reception from two geostationary satellites in different orbital positions.

* * * * *